US011035069B2

(12) United States Patent
Lee et al.

(10) Patent No.: US 11,035,069 B2
(45) Date of Patent: Jun. 15, 2021

(54) LAUNDRY TREATING APPARATUS

(71) Applicant: LG ELECTRONICS INC., Seoul (KR)

(72) Inventors: Jihong Lee, Seoul (KR); Kyungjin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 515 days.

(21) Appl. No.: 15/790,214

(22) Filed: Oct. 23, 2017

(65) Prior Publication Data

US 2019/0024292 A1 Jan. 24, 2019

(30) Foreign Application Priority Data

Jul. 19, 2017 (KR) ..... 10-2017-0091522

(51) Int. Cl.
*D06F 39/02* (2006.01)
*D06F 39/08* (2006.01)
(Continued)

(52) U.S. Cl.
CPC ..... *D06F 39/022* (2013.01); *D06F 34/28* (2020.02); *D06F 37/04* (2013.01); *D06F 37/12* (2013.01);
(Continued)

(58) Field of Classification Search
CPC .... D06F 39/022; D06F 39/005; D06F 39/085; D06F 39/088; D06F 39/14; D06F 39/02;
(Continued)

(56) References Cited

U.S. PATENT DOCUMENTS 4,700,554 A * 10/1987 Eichman ..... D06F 39/02 137/268
5,279,324 A 1/1994 Schutz et al.
(Continued)

FOREIGN PATENT DOCUMENTS

CN 201136989 10/2008
EP 0582092 2/1994
(Continued)

OTHER PUBLICATIONS

European Search Report in European Application No. 17197474.4, dated Oct. 1, 2018, 23 pages.
(Continued)

*Primary Examiner* — David G Cormier
*Assistant Examiner* — Thomas Bucci
(74) *Attorney, Agent, or Firm* — Fish & Richardson P.C.

(57) ABSTRACT

A laundry treating apparatus includes a tub, a drum, a cover defining a detergent inlet, a storage body configured to store the detergent, a barrier partitioning an interior of the storage body into first and second detergent spaces, a storage unit water supply nozzle configured to supply water to the first detergent space, a first body through hole defined at a bottom surface of the storage body, a first discharge pipe, a second discharge pipe, a siphon formation pipe surrounding the first discharge pipe and being configured to flow liquid from the first detergent space to the first body through hole based on a liquid level inside the first detergent space, and a space communication unit configured to flow liquid from the first detergent space to the second detergent space based on liquid not being discharged to an outside of the first detergent space through the first body through hole.

19 Claims, 7 Drawing Sheets

(51) Int. Cl.

| | |
|---|---|
| ***D06F 34/28*** | (2020.01) |
| ***D06F 37/04*** | (2006.01) |
| ***D06F 37/12*** | (2006.01) |
| ***D06F 37/24*** | (2006.01) |
| ***D06F 37/26*** | (2006.01) |
| ***D06F 37/30*** | (2020.01) |
| ***D06F 39/14*** | (2006.01) |
| *D06F 29/00* | (2006.01) |
| *D06F 29/02* | (2006.01) |

(52) U.S. Cl.
CPC ..... *D06F 37/24* (2013.01); *D06F 37/266* (2013.01); *D06F 37/304* (2013.01); *D06F 39/085* (2013.01); *D06F 39/088* (2013.01); *D06F 39/14* (2013.01); *D06F 29/00* (2013.01); *D06F 29/02* (2013.01); *D06F 37/267* (2013.01); *D06F 39/02* (2013.01)

(58) Field of Classification Search
CPC ..... D06F 37/04; D06F 37/12; D06F 37/24; D06F 37/266; D06F 34/304; D06F 37/267; D06F 29/00; D06F 29/02
USPC ..... 68/17 R, 12.18, 207, 27, 3 R, 13 R, 200, 68/12.19; 222/132, 416, 173, 129, 204
See application file for complete search history.

(56) References Cited

U.S. PATENT DOCUMENTS

| | | | | |
|---|---|---|---|---|
| 6,434,977 | B1 * | 8/2002 | Hapke | D06F 39/02 68/17 R |
| 6,826,933 | B2 * | 12/2004 | Merkle | D06F 39/028 68/12.18 |
| 8,074,476 | B2 * | 12/2011 | Quandt | D06F 39/02 68/17 R |
| 8,266,930 | B2 * | 9/2012 | Jeong | D06F 39/008 68/27 |
| 2005/0284193 | A1 * | 12/2005 | Lyu | D06F 39/02 68/17 R |
| 2007/0044517 | A1 | 3/2007 | Yang et al. | |
| 2009/0053119 | A1 * | 2/2009 | Richman | B01F 1/0027 422/300 |
| 2009/0113945 | A1 * | 5/2009 | Kim | D06F 17/04 68/5 C |
| 2009/0145176 | A1 * | 6/2009 | Kim | D06F 31/00 68/27 |
| 2011/0023241 | A1 | 2/2011 | Lim et al. | |
| 2011/0265524 | A1 * | 11/2011 | Kim | D06F 39/08 68/13 R |
| 2012/0024021 | A1 * | 2/2012 | Seo | D06F 39/028 68/200 |
| 2012/0125055 | A1 * | 5/2012 | Lee | D06F 39/028 68/17 R |
| 2013/0117943 | A1 * | 5/2013 | Kim | D06F 35/006 8/137 |
| 2013/0180293 | A1 * | 7/2013 | Huerth | D06F 39/02 68/17 R |
| 2013/0327101 | A1 * | 12/2013 | Leibman | D06F 23/04 68/17 R |
| 2014/0190216 | A1 * | 7/2014 | Leibman | D06F 39/022 68/12.18 |
| 2014/0190220 | A1 * | 7/2014 | Lee | D06F 39/02 68/17 R |
| 2014/0196507 | A1 * | 7/2014 | Lee | D06F 31/00 68/27 |
| 2014/0373284 | A1 * | 12/2014 | Leibman | D06F 39/022 8/137 |
| 2015/0059418 | A1 * | 3/2015 | Lee | D06F 39/02 68/17 R |
| 2015/0114047 | A1 * | 4/2015 | Jung | D06F 39/028 68/17 R |
| 2015/0135780 | A1 * | 5/2015 | Ajiki | D06F 39/022 68/17 R |
| 2015/0345062 | A1 * | 12/2015 | Lee | D06F 39/08 68/27 |
| 2015/0345071 | A1 * | 12/2015 | Lee | D06F 29/00 68/27 |
| 2016/0032517 | A1 * | 2/2016 | Lee | D06F 39/088 68/27 |
| 2016/0090681 | A1 * | 3/2016 | Nash | D06F 39/02 68/17 R |
| 2016/0194810 | A1 * | 7/2016 | Jo | D06F 39/02 68/17 R |
| 2017/0298562 | A1 * | 10/2017 | Leibman | D06F 39/02 |
| 2017/0298563 | A1 * | 10/2017 | Roetker | D06F 39/02 |

FOREIGN PATENT DOCUMENTS

| | | | | |
|---|---|---|---|---|
| EP | 0582092 | A1 * | 2/1994 | D06F 39/02 |
| EP | 1561853 | A1 * | 8/2005 | D06F 39/02 |
| EP | 2607544 | | 6/2013 | |
| FR | 2478692 | | 9/1981 | |
| JP | H03173599 | | 7/1991 | |
| JP | 2001276480 | A | 10/2001 | |
| JP | 2004-313318 | | 11/2004 | |
| KR | 20040006244 | A | 1/2004 | |
| KR | 20050014506 | A | 2/2005 | |
| KR | 20070074862 | A | 7/2007 | |
| KR | 20090052459 | A | 5/2009 | |
| KR | 20090114911 | A | 11/2009 | |
| KR | 20140130931 | A | 11/2014 | |
| KR | 20150058605 | A | 5/2015 | |
| WO | WO2005106101 | | 11/2005 | |
| WO | 2015/143912 | | 10/2015 | |

OTHER PUBLICATIONS

Partial European Search Report in European Application No. 17197474.4, dated Jun. 14, 2018, 18 pages.

* cited by examiner

【Fig. 1】
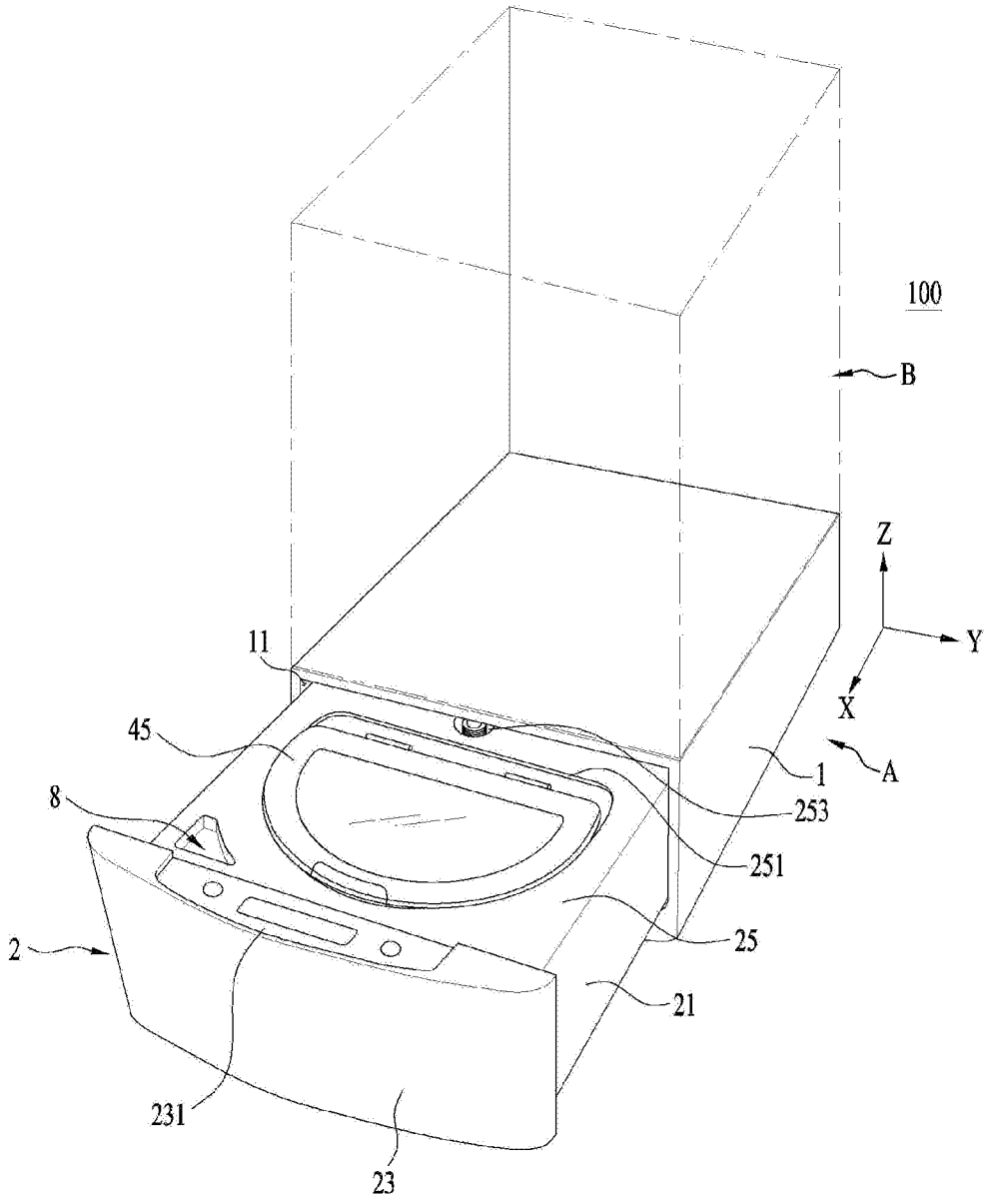

【Fig. 2】
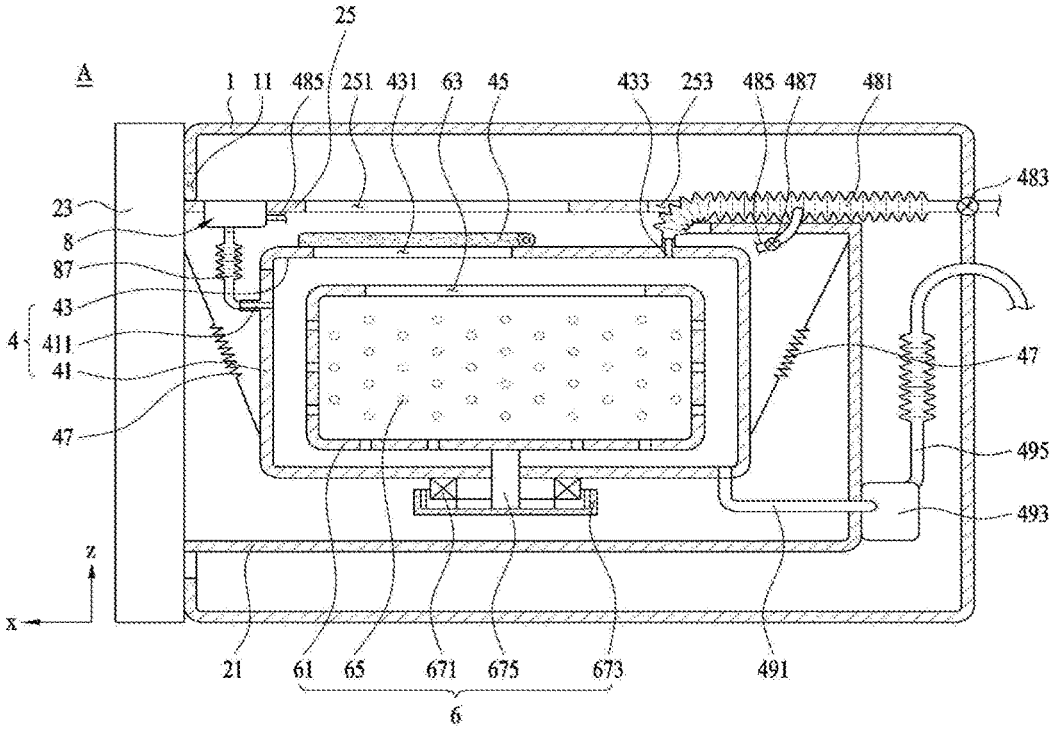
【Fig. 3】
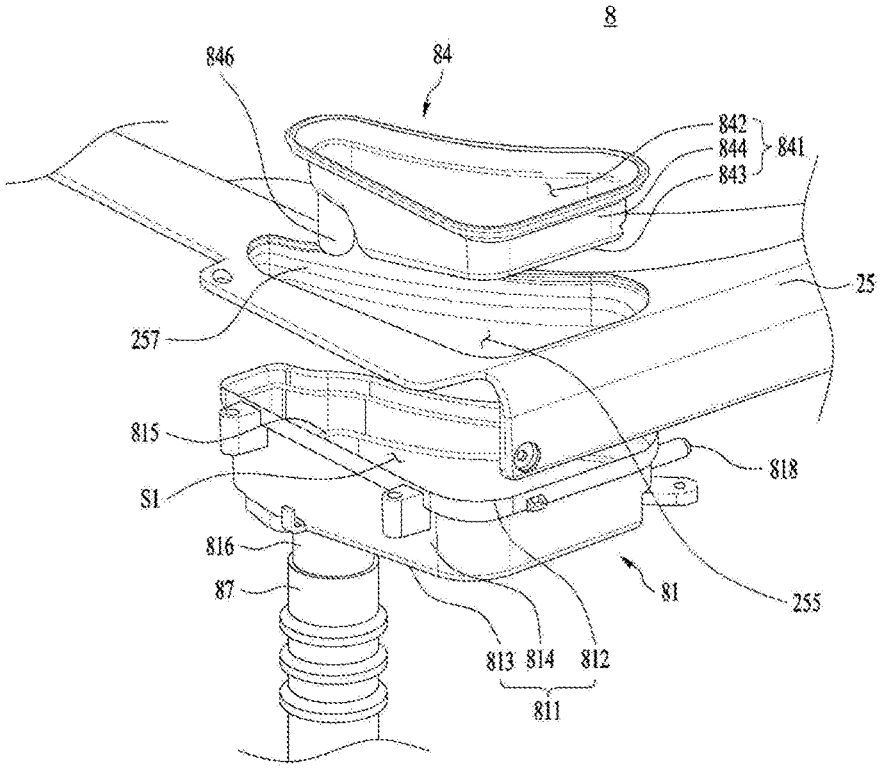

【Fig. 4】
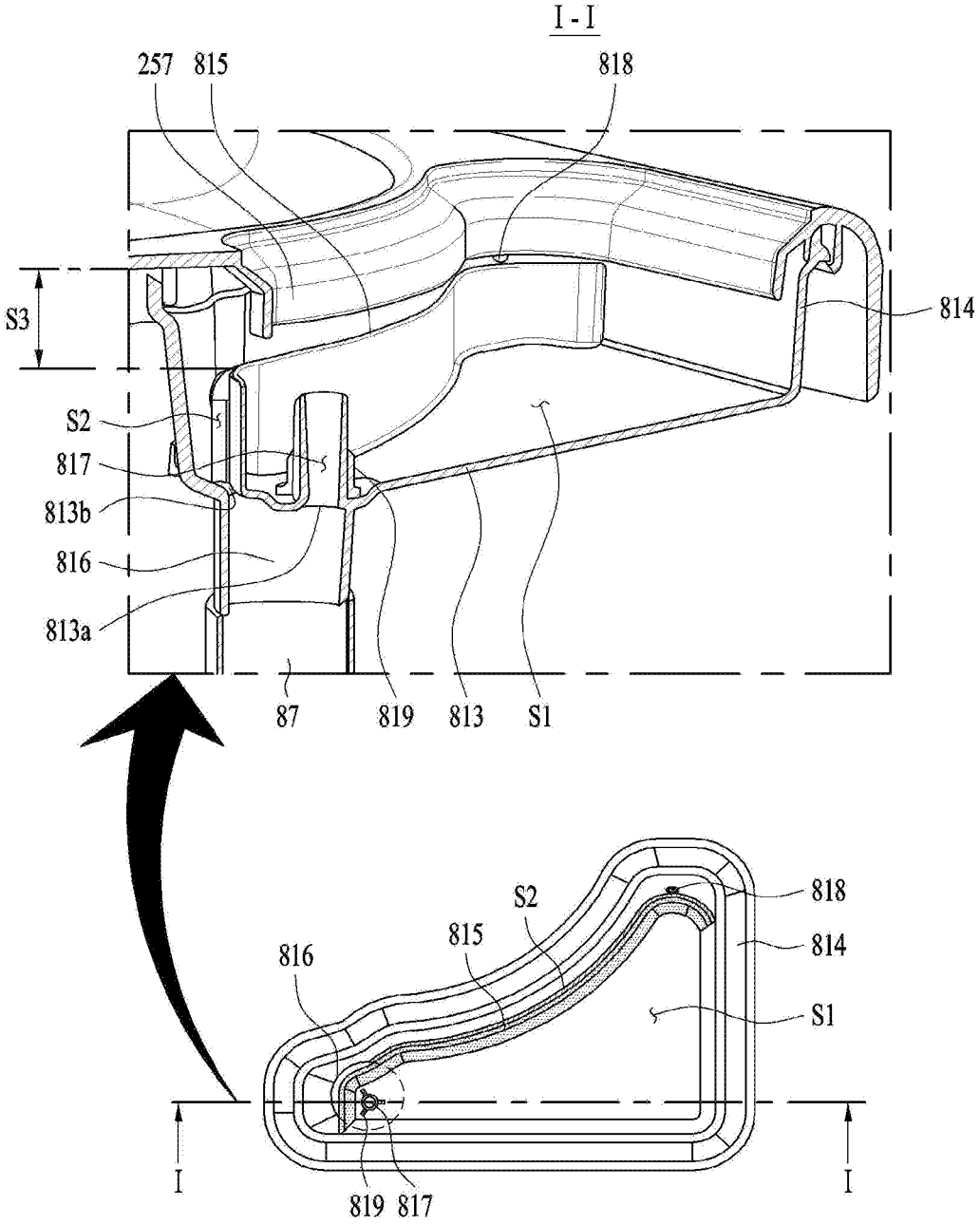

【Fig. 5】
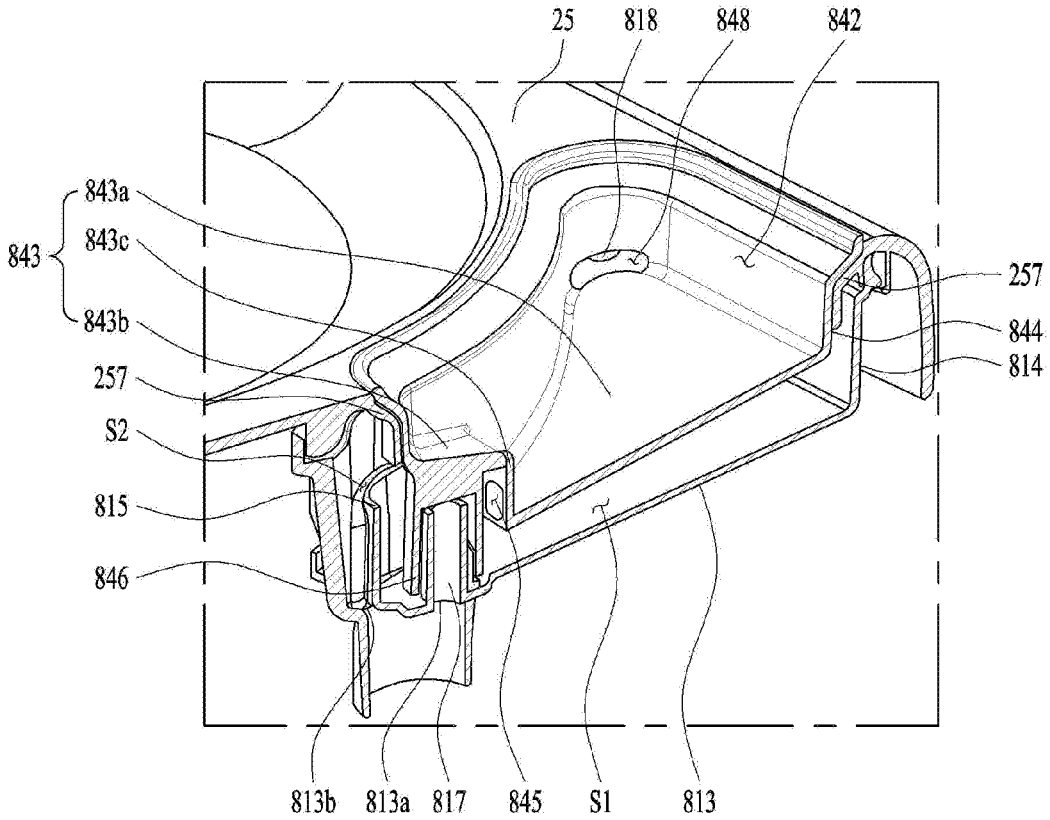

【Fig. 6】
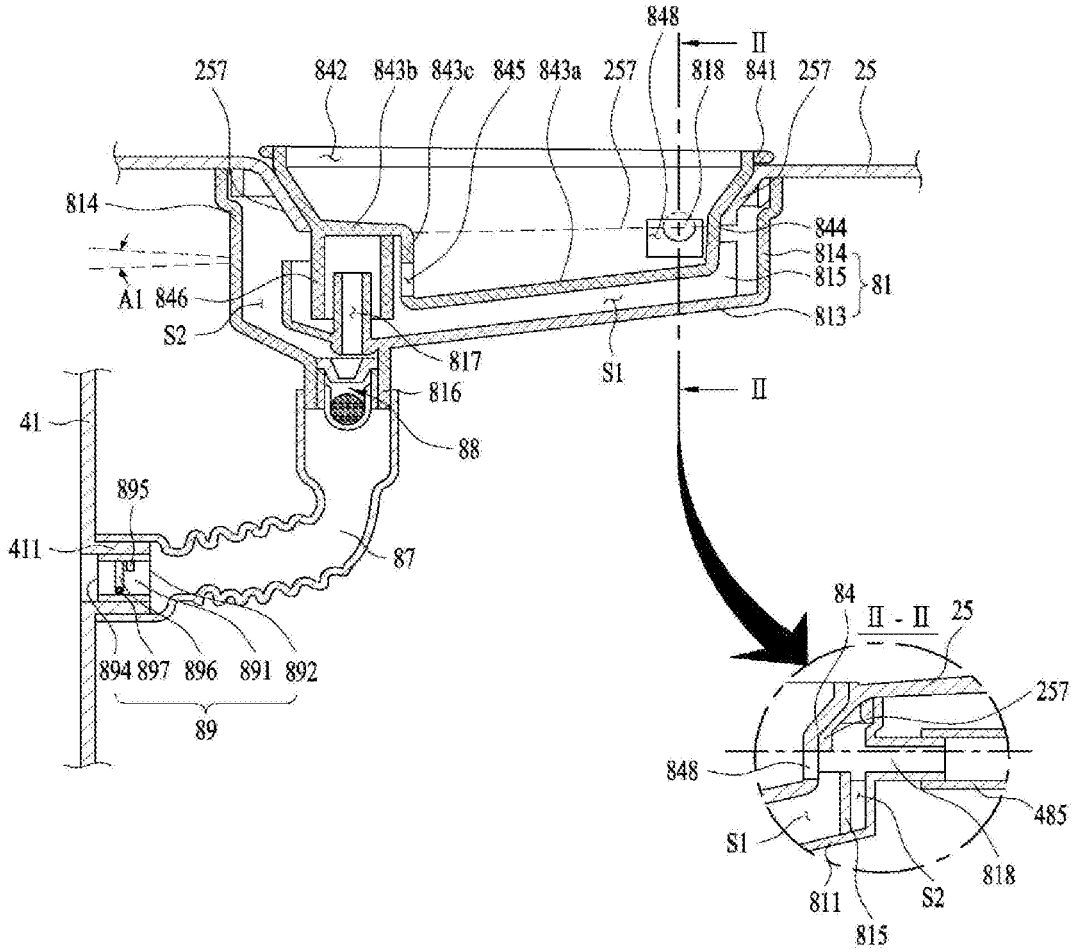

【Fig. 7】
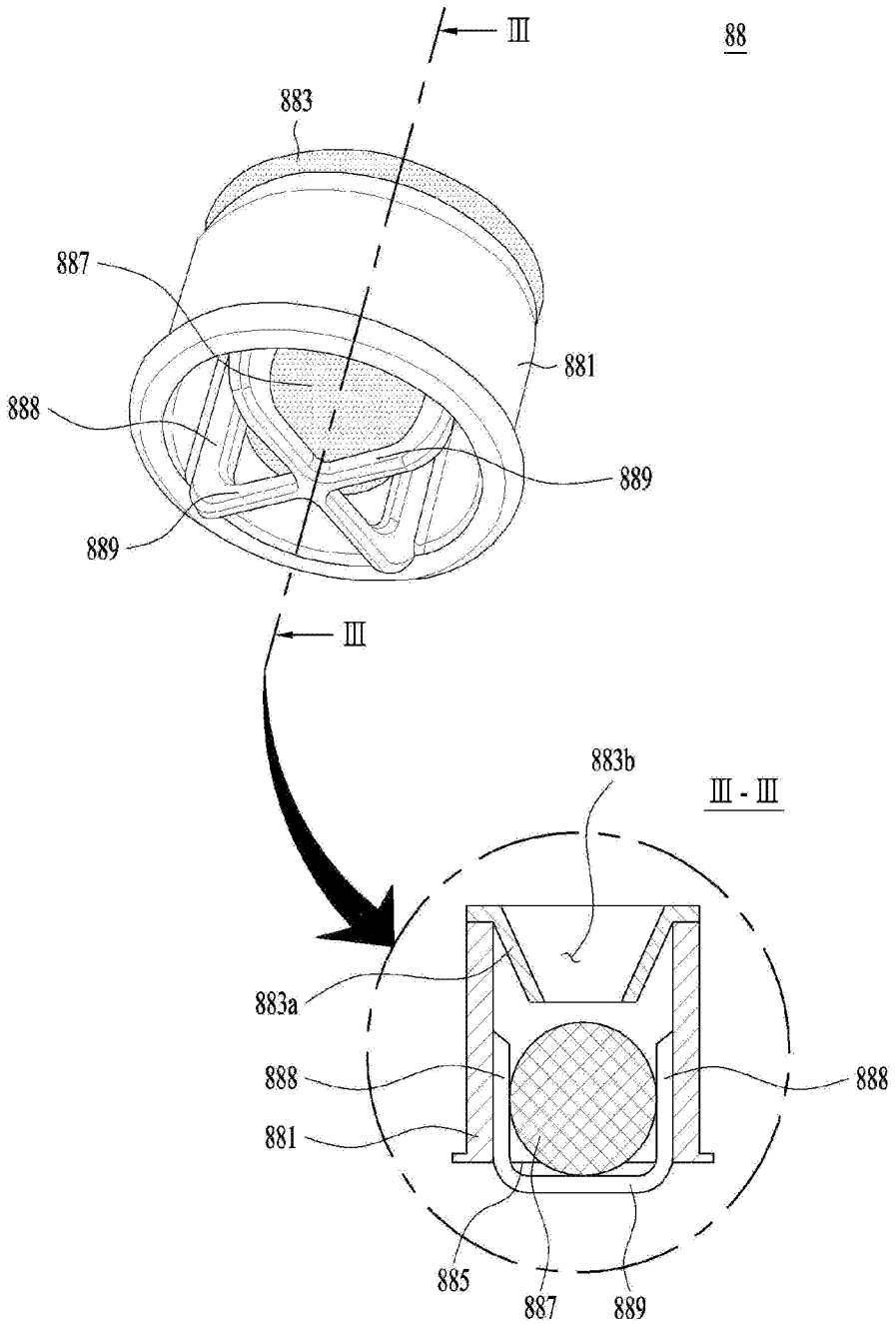

【Fig. 8】
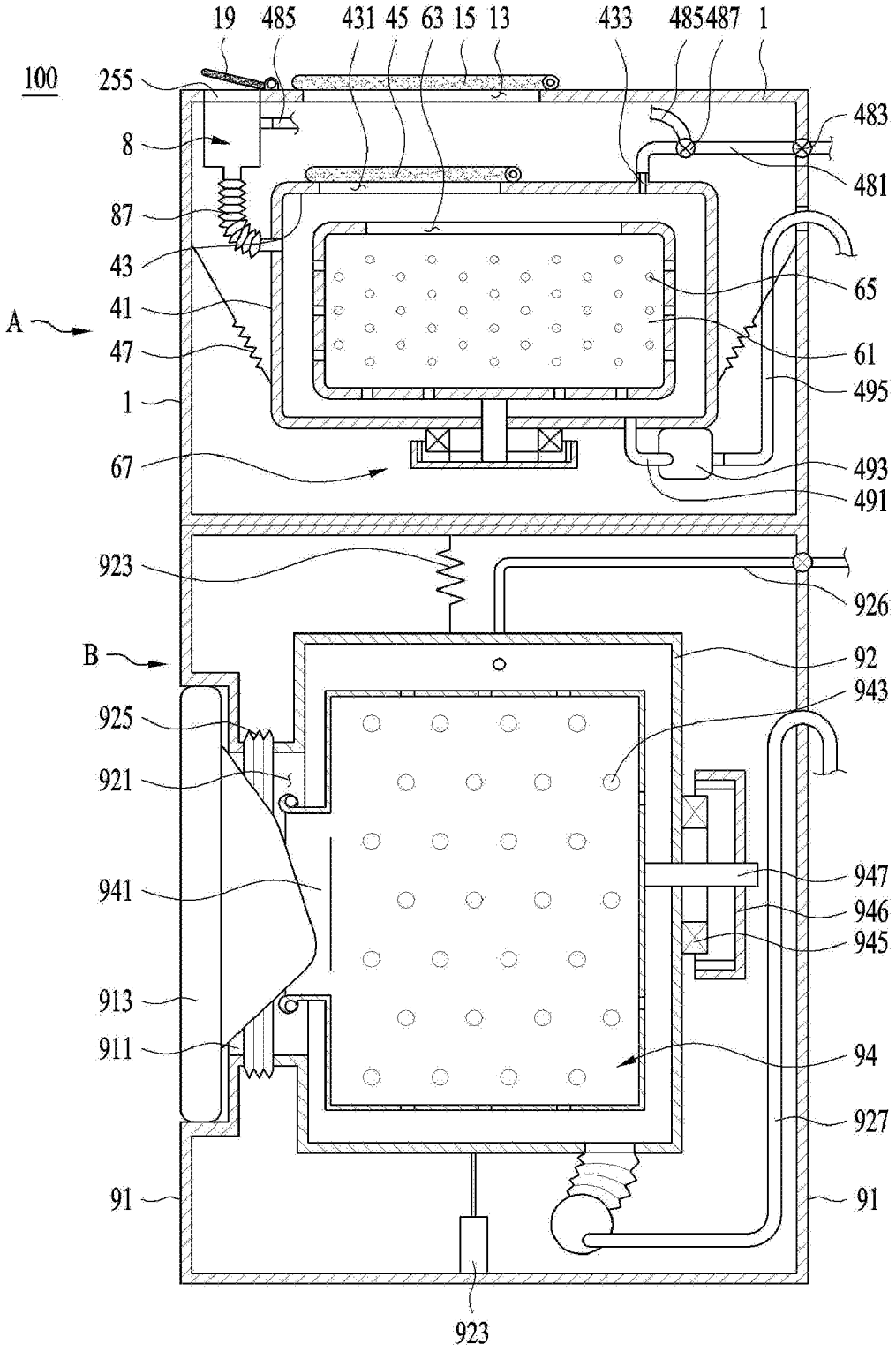

LAUNDRY TREATING APPARATUS

This application claims the benefit of the Korean Patent Application No. 10-2017-0091522, filed on Jul. 19, 2017, which is hereby incorporated by reference as if fully set forth herein.

BACKGROUND OF THE INVENTION

Field of the Invention

The present invention relates to a laundry treating apparatus.

Discussion of the Related Art

Generally, a laundry treating apparatus includes an apparatus for washing laundry (laundry for washing or laundry for drying), an apparatus for drying laundry, and an apparatus for performing both washing and drying laundry.

The laundry treating apparatus of the related art, which can wash laundry, includes a tub in which water is stored, a drum rotatably provided inside the tub to store laundry therein, and a detergent supply unit for supplying a detergent to the tub.

The laundry treating apparatus of the related art includes a storage body for providing a space where a detergent is stored, a storage unit water supply pipe for supplying water to the storage body, and a detergent supply unit that includes a siphon formation portion for moving the detergent and water to a tub by causing siphon if a water level inside the storage body exceeds a preset water level.

However, the detergent supply unit having the aforementioned structure has a problem in that a mixture of the detergent and water is not supplied to the tub if an outlet provided in the siphon formation portion is blocked or the siphon formation portion is damaged.

Also, the laundry treating apparatus which includes the aforementioned detergent supply unit is provided to further include a valve for opening or closing the storage unit water supply pipe. In this case, if the valve for opening or closing the storage unit water supply pipe is out of order, since water supplied from a water supply source is immediately supplied to the storage body, a problem may occur in that the detergent is supplied to the tub at an unwanted timing.

Also, the laundry treating apparatus of the related art needs a means for easily controlling water supply of the tub and water supply of the detergent supply unit.

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus that may supply a detergent stored in a detergent supply unit to a tub even in the case that a means for causing siphon is damaged.

Another object of the present invention is to provide a laundry treating apparatus that may supply a detergent stored in a detergent supply unit to a tub at a desired timing even in the case that a valve for controlling water supply to the detergent supply unit.

Other object of the present invention is to provide a laundry treating apparatus that prevents water stored in a tub from flowing backward to a detergent supply unit through a path that connects the tub with the detergent supply unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus comprises a tub for providing a space where water is stored; a drum rotatably provided inside the tub, for storing laundry therein; a cover provided with a detergent inlet; a storage body arranged below the cover, providing a space where a detergent is stored; a barrier provided in the storage body, for partitioning the inside of the storage body into a first space where the detergent entering through the detergent inlet is stored, and a second space detached from the second space; a storage unit water supply inlet allowing water to enter the first space; a first body through hole provided to pass through a bottom of the storage body, communicating the first space with the tub; a first discharge pipe protruded toward the cover from the first body through hole; a second discharge pipe provided on a bottom of the storage body, communicating the second space with the tub; a siphon formation pipe provided to surround the first discharge pipe, moving a liquid inside the first space to the first body through hole if a water level inside the first space is higher than a height of the first discharge pipe; and a space communication unit for moving the liquid inside the first space to the second space if the liquid is not discharged to the outside of the first space through the first body through hole.

The space communication unit may include a barrier through hole provided to pass through the barrier and provided to be higher than the first discharge pipe and lower than the detergent inlet.

The barrier may be provided to be protruded toward the cover from the bottom of the storage body, and the space communication unit is a space formed by a free end of the barrier, which is formed to be higher than that of the first discharge pipe and lower than the detergent inlet.

The storage unit water supply inlet may be provided to pass through one surface of the storage body for forming the second space together with the barrier, among the space provided by the storage body, and may be provided to be higher than the free end of the barrier and lower than the detergent inlet.

The laundry treating apparatus of the present invention may further comprise a cabinet having an outlet on a front surface; a drawer body provided to be ejected from the inside of the cabinet to the outside of the cabinet through the outlet, providing a space where the tub is received; a drawer cover forming an upper surface of the drawer body; a tub inlet provided to pass through an upper surface of the tub; a through hole provided to pass through an upper surface of the drawer cover and arranged above the tub inlet; and a fitting hole provided to pass through the drawer cover, providing a space where the cover is provided.

The laundry treating apparatus of the present invention may further comprise a tub water supply pipe for connecting a water supply source with the tub; a storage unit water supply pipe forked from the tub water supply pipe and connected to the storage unit water supply inlet; a first valve for opening or closing the tub water supply pipe; and a second valve for opening or closing the storage unit water supply pipe.

The cover may be coupled to the drawer cover through the fitting hole, and the storage body is fixed to the drawer cover and arranged below the fitting hole.

The cover may include a cover bottom arranged above the storage body; a cover side fixed to the cover bottom to form storage spaces together with the cover bottom and detachably coupled to the fitting hole; and a communication hole provided to pass through the cover bottom or the cover side, discharging the detergent supplied through the detergent inlet inside the storage spaces to the first space.

The laundry treating apparatus of the present invention may further comprise a cover water supply inlet provided to pass through the cover side, allowing the water discharged from the storage unit water supply inlet to partially enter the storage spaces.

The laundry treating apparatus of the present invention may further comprise a guide extended toward the inside of the first space from an edge of the fitting hole to support the cover side, wherein a free end of the guide is arranged between the cover side and the barrier to attenuate a flow velocity of the water discharged from the storage unit water supply inlet.

The laundry treating apparatus of the present invention may further comprise a cabinet providing a space where the tub is received; an inlet provided to pass through the upper surface of the tub; a cabinet inlet provided to pass through the upper surface of the cabinet and arranged above the inlet; and a fitting hole provided to the upper surface of the cabinet, providing a space where the cover is provided.

The laundry treating apparatus of the present invention may further comprise a detergent inlet provided to pass through the tub; a connection pipe for connecting the detergent inlet with the second discharge pipe; a first backward flow preventer provided in the second discharge pipe to prevent the water inside the tub from entering the storage body; and a second backward flow preventer provided in the detergent inlet to prevent the water inside the tub from entering the storage body, wherein the first body through hole may be provided to discharge the liquid inside the first space to the second discharge pipe.

The first body through hole may be provided to discharge the liquid inside the first space to the second discharge pipe.

The laundry treating apparatus of the present invention may further comprise a detergent inlet provided to pass through the tub; a connection pipe for connecting the detergent inlet with the second discharge pipe; a first backward flow preventer provided in the second discharge pipe to prevent the water inside the tub from entering the storage body; and a second backward flow preventer provided in the detergent inlet to prevent the water inside the tub from entering the storage body.

The first backward flow preventer may include a first communication pipe inserted to the second discharge pipe; a first communication pipe inlet for allowing the liquid to enter the first communication pipe; a first communication pipe discharge outlet for discharging the liquid inside the first communication pipe to the connection pipe; a ball reciprocating inside the first communication pipe and closing the first communication pipe if the water inside the tub enters the first communication pipe discharge outlet; a support unit provided in the first communication pipe to allow the ball to be mounted thereon; and a path formation portion protruded toward the ball from an inner circumferential surface of the first communication pipe to form a path between the inner circumferential surface of the first communication pipe and an outer circumferential surface of the ball.

The second backward flow preventer may include a second communication pipe inserted to the detergent inlet pipe; a second communication pipe inlet for allowing the liquid to enter the second communication pipe; a second communication pipe discharge outlet for discharging the liquid inside the second communication pipe to the detergent inlet pipe; a blocking board rotatably provided inside the second communication pipe to block entrance of the liquid inside the tub to the connection pipe and allow the liquid inside the connection pipe to enter the tub.

According to the present invention, a laundry treating apparatus may be provided, which may supply a detergent stored in a detergent supply unit to a tub even in the case that a means for causing siphon is damaged.

Also, according to the present invention, a laundry treating apparatus may be provided, which may supply a detergent stored in a detergent supply unit to a tub at a desired timing even in the case that a valve for controlling water supply to the detergent supply unit.

Also, according to the present invention, a laundry treating apparatus may be provided, which prevents water stored in a tub from flowing backward to a detergent supply unit through a path that connects the tub with the detergent supply unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 illustrates an example of a laundry treating apparatus according to the present invention;

FIG. 2 illustrates an example of a first treating apparatus provided in the present invention;

FIGS. 3 to 6 illustrate an example of a detergent supply unit provided in the present invention;

FIG. 7 illustrates an example of a first backward flow preventer provided in the present invention; and FIG. 8 illustrates another example of a laundry treating apparatus according to the present invention.

DETAILED DESCRIPTION OF THE INVENTION

Reference will now be made in detail to the preferred embodiments of the present invention, examples of which are illustrated in the accompanying drawings. Meanwhile, elements or control method of apparatuses which will be described below are only intended to describe the embodiments of the present invention and are not intended to restrict the scope of the present invention. Wherever possible, the same reference numbers will be used throughout the drawings to refer to the same or like parts.

As shown in FIG. 1, a laundry treating apparatus 100 according to the present invention may include a first treating apparatus A for washing laundry, and a second treating apparatus B arranged on the first treating apparatus to wash or dry laundry.

As shown in FIG. 2, the first treating apparatus A may include a cabinet 1, a drawer 2 that may be ejected from the cabinet, a tub 4 provided inside the drawer, for storing water therein, and a drum 6 rotatably provided inside the tub, for storing laundry therein.

The cabinet 1 may be provided as a means for forming an external appearance of the first treating apparatus A, or may be provided as a space (space formed at a wall, etc.) for simply receiving the drawer 2. In any case, it is preferable that an outlet 11 to which the drawer 2 may be inserted is provided on a front surface of the cabinet 1.

The cabinet 1 may be provided to have a width direction (Y-axis direction) of which length is longer than a length of a height direction (Z-axis direction) (A width length of the drawer may be provided to be longer than a length of a height direction).

The drawer 2 may include a drawer body 21 inserted into the cabinet 1 through the outlet 11, a drawer panel 23 fixed to a front surface of the drawer body 21, opening or closing the outlet 11, and a drawer cover 25 for forming an upper surface of the drawer body 21.

If the drawer body 21 is inserted into the cabinet 1, the drawer panel 23 will close the outlet 11, and if the drawer body 21 is ejected from the cabinet 1, the drawer panel 23 will open the outlet 11.

The drawer panel 23 may include a control panel 231 (see FIG. 1) for inputting a control command related to an operation of the laundry treating apparatus 100 and displaying a message related to the operation of the laundry treating apparatus to a user.

The drawer body 21 may be inserted to the cabinet 1 through the inlet 11, and may be provided in all shapes that may provide a space for receiving the tub 4. FIG. 2 illustrates an example of a hexahedral shaped hollow drawer body 21.

The drawer cover 25 includes a first through hole 251 and a second through hole 253 that communicate the inside of the drawer body 21 with the outside thereof. The first through hole 251 should be provided for insertion and ejection of laundry, and the second through hole 253 should be provided for supply of water required for washing of laundry. A detailed description of the first and second through holes 251 and 253 will be given later.

The tub 4 includes a tub body 41 arranged inside the drawer body 21, in which water is stored, and a tub cover 43 forming an upper surface of the tub body 41.

The tub body 41 may be provided in a hollow cylindrical shape. The tub cover 43 may include a tub inlet 431 for communicating the inside of the tub body 41 with the outside of the tub body 41, and a water supply pipe connector 433 for flowing water into the tub body 41.

The tub inlet 431 may be provided below the first through hole 251 provided in the drawer cover, and the water supply pipe connector 433 may be provided below the second through hole 253 of the drawer cover.

The tub inlet 431 is a means for inserting laundry into the tub body 41 or ejecting the laundry inside the tub body 41 to the outside of the tub body, and may be opened or closed by a door 45 rotatably coupled to the tub cover 43.

The tub 4 having the aforementioned structure may be fixed to the drawer body 21 through a tub support unit 47. The tub support unit 47 may be provided as a means for attenuating vibration generated in the tub body 41.

The drum 6 provided inside the tub 4 may include a cylindrical shaped drum body 61 provided with a drum inlet 63 provided on an upper surface. Since the drum inlet 63 is arranged below the tub inlet 431, laundry supplied from the outside of the tub through the tub inlet 431 may be supplied to the drum body 61 through the drum inlet 63.

A plurality of drum through holes 65 for communicating the inside of the drum body 61 with the tub body 41 may be provided on a bottom and a circumferential surface of the drum body 61.

The drum body 61 is rotated inside the tub body 41 by a driving unit 67. The driving unit 67 may include a stator 671 fixed to a bottom of the tub body and arranged outside the tub body 41, a rotor 673 rotated by a rotating field provided by the stator, and a rotary shaft 675 provided to pass through the bottom of the tub body 41, connecting the bottom of the drum body with the rotor.

In this case, the rotary shaft 675 may be provided to be orthogonal to the bottom of the tub body 41, and the drum inlet 63 may be provided to be parallel with the ground. The expression that the rotary shaft 675 is to be orthogonal to the bottom of the tub body 41 means that an angle between the rotary shaft and the bottom of the tub body is 90° within an error range (tolerance required during design or assembly).

The first treating apparatus A having the aforementioned structure supplies water to the tub 4 through a first water supply unit and discharges the water stored in the tub 4 to the outside of the cabinet 1 through a drainage unit.

The first water supply unit may include a tub water supply pipe 481 for connecting the water supply source arranged outside the cabinet with the water supply pipe connector 433, and a first valve 483 for controlling opening or closing of the tub water supply pipe 481. The tub water supply pipe 481 may be provided as a corrugated pipe (pipe provided as an elastic material along a length direction or elastic pipe in a length direction). The tub water supply pipe 481 is opened or closed by the first valve 483. The water supplied from the water supply source will be supplied to the tub when a controller (not shown) opens the tub water supply pipe 481 through the first valve 483.

The drainage unit may include a drainage pump 493 fixed to the drawer body 21, a first tub drainage pipe 491 for guiding the water inside the tub body 41 to the drainage pump 493, and a second tub drainage pipe 495 for guiding the water discharged from the drainage pump 493 to the outside of the cabinet 1. In this case, the second tub drainage pipe 495 may be provided as a corrugated pipe.

The first treating apparatus A further includes a detergent supply unit 8 for supplying a detergent to the tub body 41. The detergent supply unit 8 may be provided in the drawer body 21 or the drawer panel 23. FIG. 2 illustrates that the detergent supply unit is provided in the drawer cover 25 as an example. If the detergent supply unit 8 is provided in the drawer panel 23, it is preferable that the detergent supply unit 8 is provided on an upper surface of the drawer panel provided with the control panel among the space provided by the drawer panel 23 in consideration of user access.

The detergent supplied to the tub body through the detergent supply unit includes a washing detergent supplied to laundry during a washing course to remove particles from the laundry, a rinsing detergent supplied to the laundry during a rinsing course of the laundry to soften the laundry, and a material, such as a bleaching agent, supplied to the laundry to make the laundry white.

As shown in FIG. 3, the detergent supply unit may be fixed to the drawer 2 through a fitting hole 255 provided to pass through the drawer cover 25. That is, the detergent supply unit may include a storage unit 81 fixed to the drawer cover 25 to be arranged below the fitting hole 255, a cover 84 arranged above the storage unit 81 by being supported in the fitting hole 255 or fixed to the storage unit 81 by being inserted to the fitting hole 255, and a connection pipe 87 for connecting the storage unit 81 with the tub body 41.

The storage unit 81 may be provided as a storage body 811 for providing a space where a detergent is stored. The storage body 811 may be provided in all shapes that may provide a space for storing the detergent. In FIG. 3, the storage body 811 may include a body upper surface 812 provided with an opened surface, a body bottom 813 arranged below the fitting hole 255, and a body side 814 provided along an edge of the body bottom, forming a space for storing the detergent, together with the body bottom 813.

The body upper surface 812 may surround an edge of the fitting hole 255, and may be provided in all shapes that may communicate the inside of the storage body 811 with the outside of the drawer cover through the fitting hole 255.

As shown in FIG. 4, the storage unit 81 may further include a barrier 815 for partitioning an inner space of the storage body 811 into a first space S1 where the detergent is stored, and a second space S2 detached from the first space, forming a path. The barrier 815 may be provided as a board extended from the body bottom 813 to the cover 84.

The first space S1 may be provided to be communicated with the tub body 41 through a first body through hole 813*a* passing through the body bottom 813, and the second space S2 may be provided to be communicated with the tub body 41 through a second body through hole 813*b* passing through the body bottom 813.

A first discharge pipe 817 is connected to the first body through hole 813*a*, and a second discharge pipe 816 is connected to the second body through hole 813*b*. The first discharge pipe 817 is a pipe protruded toward the body upper surface from the body bottom 813, and a liquid inside the first space S1 moves to the first body through hole 813*a* through the first discharge pipe 817.

One end of the connection pipe 87 may be fixed to the second discharge pipe 816. In this case, the first body through hole 813*a* may be provided to communicate the first space S1 with the second discharge pipe 816.

Although not shown, the first body through hole 813*a* may be provided to directly supply the liquid (mixture of detergent and water), which is discharged from the first space S1, to the connection pipe 87 without passing through the second discharge pipe 816.

The first space S1 is supplied with water through a storage unit water supply inlet 818 provided to pass through the body side 814, wherein the storage unit water supply inlet 818 is connected to the water supply source through the second water supply unit.

As shown in FIG. 2, the second water supply unit may include a storage unit water supply pipe 485 forked from the tub water supply pipe 481 and connected to the storage unit water supply inlet 818, and a second valve 487 for opening or closing the storage unit water supply pipe. If the second valve 487 opens the storage unit water supply pipe 485 in accordance with a control signal of the controller in a state that the first valve 483 opens the tub water supply pipe 481, a part of the water supplied from the water supply source will be supplied to the tub body 41 through the tub water supply pipe 481, and the other part of the water will be supplied to the first space S1 through the storage unit water supply pipe 485 and the storage unit water supply inlet 818.

As shown in FIG. 5, the cover 84 may be provided as a cover body 841 inserted to the fitting hole 255. The cover body 841 includes a cover bottom 843 arranged above the storage body 811, a cover side 844 fixed to the cover bottom, forming storage spaces 843 and 844 together with the cover bottom, and a detergent inlet 842 provided on the cover body, allowing the detergent to enter the storage spaces 843 and 844.

The fitting hole 255 may further include a guide 257 to allow the cover body 741 to be easily coupled to the fitting hole 255. The guide 257 may be provided as a board extended toward the inside of the first space S1 from the edge of the fitting hole 255. In this case, the cover side 844 may be provided in a shape that may be mounted on the guide 257. That is, the cover side 844 may be supported in the guide 257 and detachably be coupled to the fitting hole 255.

The guide 257 may be provided as an inclined surface protruded toward the center of the fitting hole 255 from the edge of the fitting hole 255 and downwardly inclined toward the center of the fitting hole 255.

The storage spaces formed by the cover bottom 843 and the cover side 844 are communicated with the first space S1 through a communication hole 845. Therefore, the detergent entering the storage spaces of the cover body 841 through the detergent inlet 842 is moved to the first space S1 through the communication hole 845. To allow the detergent supplied to the spaces to easily enter the first space S1, the cover bottom 843 may be provided to be downwardly inclined toward the communication hole 845.

The detergent inlet 842 may be provided as an opened surface formed on an upper surface of the cover body 841, or may be provided as a hole provided to pass through the upper surface of the cover body 841.

The detergent supply unit 8 provided in the present invention further includes a siphon formation pipe 846 for forming a siphon guider together with the first discharge pipe 817 provided in the storage body 811. The siphon formation pipe 846 is a means provided to surround the first discharge pipe 817, moving a liquid (mixture of detergent and water) inside the first space S1 to the first body through hole 813*a* if a water level inside the first space S1 is higher than a height of the first discharge pipe 817. FIG. 5 illustrates that the siphon formation pipe 846 is provided as a pipe protruded toward the body bottom 813 from the cover bottom 843 as an example.

In this case, the cover bottom 843 may include a first bottom 845*a*, a second bottom 843*b* provided to be higher than the first bottom, providing a space to which the siphon formation pipe 846 is fixed, and a connection surface 843*c* connecting the first bottom with the second bottom, provided with the communication hole 845. Preferably, the first bottom 843*a* is provided to be downwardly inclined toward the communication hole 845, and the second bottom 843*b* is provided to be downwardly inclined toward an upper end of the connection surface 843*c*.

The storage body 811 includes a spacer 819 which is a means for maintaining an interval between an inner circumferential surface of the siphon formation pipe 846 and an outer circumferential surface of the first discharge pipe 817 and an interval between a lower end of the siphon formation pipe 846 and the body bottom 813.

Meanwhile, a problem may occur in that the detergent supply unit 8 having the aforementioned structure only fails to supply the detergent stored in the first space S1 to the tub 4 if the siphon guider is damaged (if the first body through hole is blocked, the siphon formation pipe is damaged, etc.). That is, if water is supplied to the first space S1, a risk occurs in that the detergent stored in the first space S1 may leak into the cabinet 1 together with the water through the communication hole 845 and the detergent inlet 842.

To solve the problem, the detergent supply unit 8 provided in the present invention include a space communication unit provided on the barrier 815, communicating the first space S1 with the second space S2.

As shown in FIG. 4, the space communication unit may be provided as a space S3 formed as a free end of the barrier 815 is higher than that of the first discharge pipe 817 and is lower than the detergent inlet 842.

If the barrier 815 is provided as a board extended toward the cover 84 from the body bottom 813 so that an upper end of the barrier 813 is in contact with the cover 84, the space communication unit may be provided as a barrier through hole provided to pass through the barrier 815. In this case, the barrier through hole should be provided to be higher than the free end of the first discharge pipe 817 and lower than the detergent inlet 842.

It is supposed that the aforementioned space communication unit S3 is provided in the barrier 815. In this case, if the liquid inside the first space S1 is not discharged to the outside of the first space S1 through the first body through hole 813*a*, the liquid inside the first space S1 is moved to the second space S2, and the liquid moved to the second space S2 will be supplied to the tub body 41 through the second body through hole 813*b* and the second discharge pipe 816. Therefore, the detergent supply unit provided in the present invention may supply the detergent to the tub body even though the siphon guider is damaged.

Meanwhile, since the detergent supply unit 8 provided in the present invention has a structure that the detergent is stored in the first space S1 by being supplied to the communication hole 845 along the cover bottom 843, the detergent may remain in the cover bottom 843. If the detergent remains in the cover bottom 843, a sanitary problem may be caused. To solve the problem, the detergent supply unit 8 may further include a cover water supply inlet 848 for preventing the detergent from remaining in the cover bottom 843.

As shown in FIG. 6, the cover water supply inlet 848 is a means provided to pass through the cover side 844, allowing the water supplied from the storage unit water supply inlet 818 to partially enter the storage spaces formed by the cover bottom 843 and the cover side 844. Therefore, the water supplied to the first space S1 through the storage unit water supply inlet 818 partially enters the cover body 841 through the cover water supply inlet 848, and the water entering the cover body 841 will be supplied to the first space S1 through the communication hole 845 after washing the cover bottom 843. Therefore, in the present invention, the problem that the detergent remains in the cover body may be minimized.

Meanwhile, a water pressure of water supplied from the water supply source may be varied depending on zones where the laundry treating apparatus is provided. If a water pressure of the zone where the laundry treating apparatus is provided is high, a pressure of water supplied to the first space S1 through the storage unit water supply pipe 485 will be high. Therefore, a problem may occur in that the water supplied to the first space S1 through the storage unit water supply inlet 818 may detach the cover 84 from the fitting hole 255 or discharge the detergent stored in the first space S1 to the outside of the detergent supply unit 8.

To solve the problem, a free end of the guide 257 may be provided to be arranged between the cover side 844 and the barrier 815, thereby attenuating a flow velocity of the water supplied from the storage unit water supply inlet 818. That is, as shown in FIG. 6, the guide 257 may be extended toward the first space S1 from the fitting hole 255 to close a partial area of the storage unit water supply inlet 818 if the guider is projected in the cover side 844.

The detergent supply unit 8 having the aforementioned structure supplies the detergent to the tub body 41 through the connection pipe 87 as described above, and a diameter of each bottom of the drum body 61 and the tub body 41 provided in the present invention is set to be longer than its height, whereby a problem may occur in that the water inside the tub body may backward flow toward the detergent supply unit 8 through the connection pipe 87 when the drum body 61 is rotated. To solve this problem, the present invention may further include a first backward flow preventer 88 and a second backward flow preventer 89.

One end of the connection pipe 87 may be fixed to the second discharge pipe 816 and its other end may be fixed to a detergent inlet pipe 411 provided to pass through the circumferential surface of the tub body 41. In this case, it is preferable that the first backward flow preventer 88 is fixed to the second discharge pipe 816 and the second backward flow preventer 89 is fixed to the detergent inlet pipe 411. This facilitates assembly of the backward flow preventers 78 and 89.

That is, if the backward flow preventers 88 and 89 are respectively provided in the second discharge pipe 816 and the detergent inlet pipe 411, they may be assembled more easily than the case that at least one of the backward flow preventers is provided inside the connection pipe 87.

As shown in FIG. 7, the first backward flow preventer 88 may include a first communication pipe 881 inserted and fixed to the second discharge pipe 816, a sealing unit 883 for allowing the liquid (mixture of detergent and water) to enter the first communication pipe 881, a first communication pipe discharge outlet 885 for discharging the liquid inside the first communication pipe 881 to the connection pipe 87, a ball 887 reciprocating inside the first communication pipe 881, and a support unit 889 provided in the first communication pipe discharge outlet 885 to allow the ball 887 to be mounted thereon.

The first communication pipe 881 may be provided in a cylindrical shape in which both surfaces (upper surface and lower surface) facing each other are opened. In this case, the first communication pipe discharge outlet 885 may be an opened surface of the first communication pipe 881.

The sealing unit 883 may include a sealing body 883*a* coupled to the opened upper surface of the first communication pipe 881, and a first communication pipe inlet 883*b* provided to pass through the sealing body 883*a*. It is preferable that the sealing body 883*a* is provided as an elastic body such as rubber.

A path formation portion 888 for forming a path between the ball 887 and the inner circumferential surface of the first communication pipe 881 is provided on the inner circumferential surface of the first communication pipe 881.

Therefore, if the water inside the tub body 41 enters the first communication pipe 881 through the connection pipe 87 and the first communication pipe discharge outlet 885 in accordance with rotation of the drum body 61, the ball 887 prevents the water inside the tub body 41 from being supplied to the detergent supply unit 8 by closing the first communication pipe inlet 883*b*.

However, if the water inside the tub body 41 does not backward flow to the first communication pipe 881 through the first communication pipe discharge outlet 885, the ball 887 maintains the state that it is mounted on the support unit 889, by means of self-load. If the ball 887 maintains the state that it is mounted on the support unit 889, a path is formed between the first communication pipe 881 and the ball 887 by the path formation portion 888. Therefore, in this state, if the water is supplied to the first space S1, the detergent will be supplied to the tub body 41 through the first discharge pipe 817, the first communication pipe inlet 883*b* and the connection pipe 87.

As shown in FIG. 6, the second backward flow preventer 89 may include a second communication pipe 891 inserted and fixed to the detergent inlet pipe 411, a second communication pipe inlet 892 for allowing the liquid to enter the second communication pipe 891, a second communication pipe discharge outlet 894 for discharging the liquid entering the second communication pipe 891 to the detergent inlet pipe 411, and a blocking board 896 provided inside the second communication pipe 891 to block entrance of the liquid inside the tub body 41 to the connection pipe 87 and allowing the liquid inside the connection pipe 87 to enter the tub body 41.

The second communication pipe 891 may also be provided in a cylindrical shape in which both surfaces (upper surface and lower surface) facing each other are opened. The blocking board 896 may rotatably be fixed into the second communication pipe 891 through a shaft 897. Also, the second communication pipe 891 may include a stopper 895 for supporting the blocking board 896 to prevent the blocking board 896 from being rotated to be far away from the tub body 41.

FIG. 8 illustrates another example of the laundry treating apparatus 100 according to the present invention. The laundry treating apparatus provided in this embodiment is different from that provided in the embodiment of FIG. 1 in that the first treating apparatus A is arranged above the second treating apparatus B.

The second treating apparatus shown in FIG. 1 and the second treating apparatus B shown in FIG. 8 may be provided to have the same structure, and FIG. 8 illustrates that the second treating apparatus B is provided for washing of laundry as an example.

The second treating apparatus B may include a second cabinet 91 that can support the cabinet 1 of the first treating apparatus A, a second tub 92 provided inside the second cabinet, for storing water therein, and a second drum 94 rotatably provided inside the second tub.

A second cabinet inlet 911 opened or closed by a second door 913 is provided on a front surface of the second cabinet 91.

The second tub 92 may be provided in a hollow cylindrical shape, and a second tub inlet 921 is provided on a front surface of the second tub 92. The second cabinet inlet 911 and the second tub inlet 921 may be connected with each other through a gasket 925 to prevent water leakage from occurring.

The second tub 92 may be fixed into the second cabinet 91 through a second tub support unit 923. The second tub 92 is supplied with water through a second water supply pipe 926, and the water stored in the second tub 92 is discharged to the outside of the second cabinet 91 through a second drainage unit 927.

The second drum 94 may be provided in a hollow cylindrical shape, and may be provided with a second drum inlet 941 at the front, wherein the second drum inlet 941 is communicated with the second cabinet inlet 911 and the second tub inlet 921.

An inner space of the second drum 94 is communicated with an inner space of the second tub 92 through a second drum through hole 943. The second drum 94 is rotated by a second driving unit that may include a second stator 945, a second rotor 946, and a second rotary shaft 947 for connecting the second drum with the second rotor by passing through a rear surface of the second tub. The second rotary shaft 947 may be provided in parallel with a bottom of the second cabinet 91.

If the first treating apparatus A provided in the present invention is provided to support the bottom of the second treating apparatus B (FIG. 1), the first treating apparatus A may be provided as described with reference to FIGS. 1 to 7.

However, if the first treating apparatus A is provided to be mounted on the second treating apparatus B as shown in FIG. 8, the first treating apparatus A provided in this embodiment may include a cabinet 1, a tub 2 provided inside the cabinet, for storing water therein, a drum 6 rotatably provided inside the tub, for storing laundry therein, and a detergent supply unit 8 for supplying a detergent to the tub. That is, if the laundry treating apparatus is configured as shown in FIG. 8, a drawer 2 may be omitted in the first treating apparatus A.

However, in the embodiment of FIG. 8, a cabinet inlet 13 arranged above the door 45 and a cabinet door 15 for opening or closing the cabinet inlet should be provided on an upper surface of the cabinet 1. Moreover, the fitting hole 255 to which the detergent supply unit 8 is fixed should be provided to pass through the upper surface of the cabinet 1. The fitting hole 255 may be provided to be opened or closed by a fitting hole door 19.

Meanwhile, in the laundry treating apparatus 100 having the aforementioned structure only, a leakage may occur in that a small amount of water may enter the storage unit water supply pipe 485 when the first valve 311 opens the tub water supply pipe 481 due to a damage of the second valve 487. If the leakage occurs in the storage unit water supply inlet, a problem may occur in that the detergent stored in the detergent storage unit 8 is not supplied to the tub 4 at a desired timing.

To solve the problem, as shown in FIG. 6, the storage unit water supply inlet 818 provided in the detergent supply unit 8 is preferably provided to pass through one surface of the storage body 811 for forming the second space S2 together with the barrier 815 among the space provided by the storage body 811. Also, the storage unit water supply inlet 818 is preferably provided to be higher than the free end of the barrier 815 and lower than the detergent inlet 842 so that the water supplied from the storage unit water supply inlet 818 may be supplied to the first space S1 by passing through the free end of the barrier 815.

The water supplied from the storage unit water supply inlet 818 is supplied to the first space S1 by passing through the free end of the barrier 815 to allow the water discharged from the storage unit water supply inlet 818 to enter the second space S2 if the pressure of the water discharged from the storage unit water supply inlet 818 is low.

Therefore, the detergent supply unit 8 provided in the present invention may prevent the detergent stored therein from being supplied to the tub at an unwanted timing even though the small amount of water leaks into the storage unit water supply pipe 485 due to a minor damage of the second valve 487.

Moreover, the free end of the barrier 815 may be provided to be downwardly inclined toward a direction that the second body through hole 813*b* is arranged from a direction that the storage unit water supply inlet 818 is arranged. This is to prevent the water from remaining in the second space S2.

Meanwhile, if a sectional area of the tub water supply pipe 481 is greater than that of the storage unit water supply pipe 485 or energy required for operation of the first valve 483 is greater than that required for operation of the second valve 487 regardless of the sectional areas of the water supply pipes, the first valve 483 and the second valve 487 are preferably controlled as follows. That is, if water is supplied to the detergent supply unit 8, it is preferable that the controller controls the first valve 483 to open the tub water supply pipe 481 after controlling the second valve 487 to open the storage unit water supply pipe 485. If the sectional area of the tub water supply pipe 481 is greater than that of the storage unit water supply pipe 485 or energy required for operation of the first valve is greater than that required for operation of the second valve, and if the tub water supply pipe 481 is first opened, a problem may occur in that the second valve 487 fails to open the storage unit water supply pipe 485 due to a water pressure even though a power is supplied to the second valve 487. On the contrary, if it is intended to block water supply to the detergent supply unit 8, it is preferable that the controller controls the first valve 483 and the second valve 487 to first close the tub water supply pipe 481 through the first valve 483 and then close the storage unit water supply pipe 485 through the second valve 487.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A laundry treating apparatus comprising:

a tub defining a space configured to receive water;

a drum rotatably mounted in the tub and configured to receive laundry;

a storage body comprising a bottom surface that defines a through hole and a side surface that defines a first water supply inlet;

a barrier disposed in the storage body, the barrier partitioning a space defined by the side surface and the bottom surface of the storage body into a first space and a second space;

a connection pipe that connects the storage body to the tub; and a cover that is detachably coupled to the storage body and that defines a communication hole configured to allow liquid to flow from the cover to the storage body, the cover comprising:

a detergent inlet configured to receive detergent, a cover bottom surface that is spaced apart from the bottom surface of the storage body in a state in which the cover is coupled to the storage body, and a cover side surface that is connected to the cover bottom surface and that defines a detergent storage space together with the cover bottom surface, the cover side surface defining a second water supply inlet, wherein the cover is configured to receive water supplied from the first water supply inlet through the second water supply inlet, wherein the barrier defines a space opening that is configured to allow liquid to flow from the first space to the second space, and wherein the through hole comprises:

a first through hole defined at the bottom surface of the storage body and configured to supply liquid in the first space of the storage body to the tub, and a second through hole defined at the bottom surface of the storage body and configured to supply liquid in the second space of the storage body to the tub.

2. The laundry treating apparatus according to claim 1, further comprising:

a cabinet defining an outlet on a front surface of the cabinet;

a drawer body configured to be ejected from an inside of the cabinet to an outside of the cabinet through the outlet, the drawer body defining a space configured to receive the tub;

a drawer cover defining an upper surface of the drawer body, the upper surface of the drawer body defining a drawer cover through hole configured to receive the laundry and a fitting hole configured to receive the cover that is detachably coupled to the storage body.

3. The laundry treating apparatus according to claim 2, further comprising:

a tub water supply pipe connecting a water supply source to the tub;

a first water supply pipe branched from the tub water supply pipe and connected to the first water supply inlet;

a first valve configured to open and close the tub water supply pipe; and a second valve configured to open or close the first water supply pipe.

4. The laundry treating apparatus according to claim 2, wherein the cover is configured to couple to the drawer cover through the fitting hole, and wherein the storage body is fixed to the drawer cover and arranged below the fitting hole.

5. The laundry treating apparatus according to claim 1, further comprising:

a cabinet defining a space configured to receive the tub, the cabinet comprising an upper surface that defines a cabinet inlet; and a fitting hole defined at the upper surface of the cabinet and configured to receive the cover.

6. The laundry treating apparatus according to claim 1, further comprising:

a first discharge pipe that protrudes from the first through hole toward the cover; and a siphon formation pipe that surrounds the first discharge pipe and that is configured to, based on a level of liquid stored in the first space being higher than a height of the first discharge pipe, supply the liquid in the first space to the first discharge pipe.

7. The laundry treating apparatus according to claim 1, further comprising:

a second discharge pipe disposed between the bottom surface of the storage body and the connection pipe, wherein the first through hole and the second through hole are defined inside one end of the second discharge pipe, and wherein one end of the connection pipe is connected to the second discharge pipe and another end of the connection pipe is connected to a side wall of the tub.

8. The laundry treating apparatus according to claim 6, wherein the space opening is defined at a location higher than an upper end of the first discharge pipe and lower than the detergent inlet.

9. The laundry treating apparatus according to claim 8, wherein the barrier protrudes from the bottom surface of the storage body toward the cover, and wherein the space opening is defined by a free end of the barrier at a location above the upper end of the first discharge pipe and below the detergent inlet.

10. The laundry treating apparatus according to claim 9, wherein the first water supply inlet is defined at a surface of the storage body that defines the second space together with the barrier, and wherein the first water supply inlet is positioned above the free end of the barrier and below the detergent inlet.

11. The laundry treating apparatus according to claim 7, further comprising:

a detergent inlet pipe connected to the tub and the connection pipe and configured to receive liquid from the second discharge pipe through the connection pipe;

a first backward flow preventer comprising a ball that is movably disposed in the second discharge pipe and that is configured to restrict water flow from the tub to the storage body; and a second backward flow preventer comprising a blocking board that is rotatably disposed in the detergent inlet pipe and that is configured to restrict water flow from the tub to the storage body.

12. The laundry treating apparatus according to claim 7, wherein the second discharge pipe is configured to receive liquid from the first space to through the first through hole.

13. The laundry treating apparatus according to claim 11, wherein the first backward flow preventer includes:

a first communication pipe that is disposed in the second discharge pipe, that defines a first communication pipe inlet and a first communication pipe discharge outlet, and that is configured to guide liquid from the second discharge pipe to the connection pipe through the first communication pipe inlet and the first communication pipe discharge outlet;

a ball configured to open and close the first communication pipe inlet by reciprocating in the first communication pipe, a support that is disposed in the first communication pipe and that supports the ball based on the ball opening the first communication pipe inlet; and a path formation protrusion that protrudes from an inner surface of the first communication pipe toward the ball and that defines a path between the inner surface of the first communication pipe and an outer surface of the ball to flow liquid through the path.

14. The laundry treating apparatus according to claim 11, wherein the second backward flow preventer includes:

a second communication pipe that is disposed in the detergent inlet pipe, that defines a second communication pipe inlet and a second communication pipe discharge outlet, and that is configured to guide liquid from the second communication pipe to the detergent inlet pipe through the second communication pipe inlet and the second communication pipe discharge outlet;

a blocking board rotatably that is disposed inside the second communication pipe, that is configured to restrict water flow from the tub to the connection pipe, and that is configured to allow liquid to flow from the connection pipe to the tub.

15. The laundry treating apparatus according to claim 13, wherein the ball is further configured to:

close the first communication pipe inlet based on water in the tub flowing toward the first communication pipe discharge outlet; and maintain the first communication pipe inlet open based on a weight of the ball or liquid flowing from the second discharge pipe toward the first communication pipe inlet.

16. The laundry treating apparatus according to claim 13, wherein the first backward flow preventer further includes a sealing unit coupled to the first communication pipe inlet, the sealing unit comprising a sealing body coupled to an upper opening side of the first communication pipe and configured to selectively provide a seal between the ball and the first communication pipe inlet.

17. The laundry treating apparatus according to claim 14, wherein the second backward flow preventer further includes a shaft located at an inner surface of the second communication pipe, and wherein the blocking board is configured to rotate about the shaft based on a flow of liquid inside the second communication pipe.

18. The laundry treating apparatus according to claim 17, wherein the second backward flow preventer further includes a stopper that protrudes inward from the inner surface of the second communication pipe and that is configured to limit rotation of the blocking board in a direction toward the connection pipe.

19. A laundry treating apparatus comprising:

a tub defining a space configured to receive water;

a drum rotatably mounted in the tub and configured to receive laundry;

a storage body comprising a bottom surface that defines a through hole and a side surface that defines a first water supply inlet;

a connection pipe that connects the storage body to the tub;

a cover that is detachably coupled to the storage body and that defines a communication hole configured to allow liquid to flow from the cover to the storage body, the cover comprising:

a detergent inlet configured to receive detergent, a cover bottom surface that is spaced apart from the bottom surface of the storage body in a state in which the cover is coupled to the storage body, and a cover side surface that is connected to the cover bottom surface and that defines a detergent storage space together with the cover bottom surface, the cover side surface defining a second water supply inlet, wherein the cover is configured to receive water supplied from the first water supply inlet through the second water supply inlet;

a cabinet defining an outlet on a front surface of the cabinet;

a drawer body configured to be ejected from an inside of the cabinet to an outside of the cabinet through the outlet, the drawer body defining a space configured to receive the tub;

a drawer cover defining an upper surface of the drawer body, the upper surface of the drawer body defining a drawer cover through hole configured to receive the laundry and a fitting hole configured to receive the cover that is detachably coupled to the storage body; and a guide extending from an edge of the fitting hole toward an inside of the storage body, the guide being configured to support the cover side surface, wherein the cover is configured to couple to the drawer cover through the fitting hole, wherein the storage body is fixed to the drawer cover and arranged below the fitting hole, and wherein the guide includes an end that is arranged between the cover side surface and the storage body and that is configured to attenuate a flow velocity of water discharged from the first water supply inlet.

* * * * *